US006599172B2

(12) United States Patent
Nagasawa et al.

(10) Patent No.: US 6,599,172 B2
(45) Date of Patent: Jul. 29, 2003

(54) METHOD FOR FORMING UNDERCOATING IN REPAIR PAINTING FOR VEHICLES

(75) Inventors: Masayoshi Nagasawa, Sayama (JP); Hideetsu Kimura, Saitama (JP); Isao Kunii, Fuchu (JP); Kyutarou Fukui, Funabashi (JP); Kazumi Watanabe, Hidaka (JP); Kuniyasu Taguchi, Abiko (JP); Tadao Shimizu, Tarumi-ku (JP); Shigemitsu Ninomiya, Yahata (JP)

(73) Assignees: AIOI Insurance Co., Ltd., Tokyo (JP); Sankyo Rikagaku Co., Ltd., Saitama-Ken (JP); Solar Co., Ltd., Hyogo-ken (JP); Teikoku Piston Ring Co., Ltd., Tokyo (JP)

( * ) Notice: Subject to any disclaimer, the term of this patent is extended or adjusted under 35 U.S.C. 154(b) by 10 days.

(21) Appl. No.: 09/897,391

(22) Filed: Jul. 3, 2001

(65) Prior Publication Data

US 2003/0032367 A1 Feb. 13, 2003

(30) Foreign Application Priority Data

Jul. 3, 2000 (JP) ..... 2000-201635

(51) Int. Cl.[7] ..... B24B 7/19
(52) U.S. Cl. ..... 451/28

(58) Field of Search ..... 451/28, 41, 355–359, 451/490; 356/237.3, 371

(56) References Cited

U.S. PATENT DOCUMENTS

| | | | | | |
|---|---|---|---|---|---|
| 4,164,492 | A | * | 8/1979 | Cooper | 260/40 R |
| 4,431,763 | A | * | 2/1984 | Reed | 524/389 |
| 5,056,203 | A | * | 10/1991 | Miller | 451/355 |
| 5,580,302 | A | * | 12/1996 | Howard, Jr. et al. | 451/357 |
| 5,709,826 | A | * | 1/1998 | Greenberg | 264/40.1 |
| 5,843,221 | A | * | 12/1998 | Parish | 106/469 |
| 6,088,093 | A | * | 7/2000 | Greenberg | 356/237.3 |

* cited by examiner

*Primary Examiner*—Lee D. Wilson
(74) *Attorney, Agent, or Firm*—Wenderoth, Lind & Ponack, L.L.P.

(57) ABSTRACT

A conventional undercoating method in repair painting on a damaged vehicle, which includes many working processes, possesses drawbacks of being low in working efficiency and making a finally repaired area exceedingly larger than an initial damaged area. To overcome the drawbacks, the invention provides a undercoat forming method using newly developed putty composed of specific compositions, which is capable of forming a thick coating layer. According to the invention, the processes of polishing of the coating layer by dry sanding and applying the putty respectively can be performed in one operation.

8 Claims, 3 Drawing Sheets

METHOD FOR FORMING UNDERCOATING IN REPAIR PAINTING FOR VEHICLES

BACKGROUND OF THE INVENTION

1. Field of the Invention

This invention relates to a method for forming undercoating to repair a damaged portion on a vehicle.

2. Description of the Prior Art

A conventional undercoating method for repairing a damaged vehicle by painting includes many processes for undercoating and is complicated, consequently to demand considerable technique and skill in a worker. Besides, the conventional method inevitably turns out to prolong the time required for working and raise the costs of using tools and materials.

To be concrete, the existing repairing method comprises the following processes. That is, the method comprises removing an old coating layer formed around a damaged portion such as a scratch or scrape in an automobile body, processing tapering the verge portion from which the old coating layer is removed into a smooth slanting (feathering edge) surface (hereinafter referred to as "smoothing process"), applying polyester putty (poly-patty) to the damaged portion, which is formed into the feathering edge, to further smooth the damaged portion, sanding the damaged portion coated with poly-patty, further applying primer surfacer (pra-saf) to the damaged portion sanded, polishing the damaged portion coated with the primer surfacer, further applying lacquer patty thereto, and then polishing it (generally called a filler process). First, the problems encountered on the filler process will be enumerated hereinafter, and thereafter, the problems encountered on the smoothing process will be enumerated.

1. Filler Process (1) Number of Processes

The method requires three different types of fillers although these fillers have a common role for smoothing the damaged portion. Namely, six works of applying the fillers and sanding in all, and therefore, often become onerous where these processes are performed.

(2) Problem on Polyester Patty

The work of applying the polyester patty must be performed with a spatula or knife since the polyester patty is high viscous, and necessitates a high technique for uniformly applying it to a panel having a complicated surface. Besides, the polyester patty has a drying mechanism of a two-pack polymerizing type. That is, it is formed of a main agent and a curing agent, which are stored in different containers. These patty materials are respectively taken out from the containers onto a working platen in use, and uniformly mingled by using the spatula. However, in mingling the patty compositions, air comes into the patty to form air bubbles in the patty. As a result, this process entails a problem such that air pores are formed in a hardened patty, which are exposed to a repaired surface by finally grinding the surface.

(3) Primer Surfacer

The primer surfacer is applied for plugging sandpaper scratches resulting from sanding the hardened polyester patty, preventing sinking of topcoating, preventing corrosion, and making sure of adhesive properties of coating composition. However, the primer surfacer is lower in viscosity than the polyester patty noted above and includes much solvent and diluent, possibly resulting in imbibition on the old coating layer and a defect in the coating layer. To avoid this disadvantage, it is necessary to apply a sealer to the coating surface and sanding the surface coated with the sealer. Consequently, the work is disadvantageously complicated. Furthermore, since the primer surfacer has low viscosity and includes much solvent and diluent, it easily permeates into the pores in the porous polyester patty, resulting in bringing about the so-called sinking phenomenon. As a result, large and deep pores and/or sandpaper scratches left in the surface of the hardened polyester patty could not be plugged completely.

(4) Lacquer Patty

The lacquer patty is applied for plugging small scrapes or pores left after grinding with primer surfacer. However, the lacquer patty has low viscosity and quick-drying property, and therefore, must be applied quickly and thinly by using the spatula. The work of applying the lacquer patty quickly and thinly requires a high technique and much skill. Besides, the lacquer patty has a solvent evaporation type drying mechanism and is weak in resin bonding power. Therefore, topcoating lacquer is sunk under the surface, consequently to form a lusterless topcoating surface. It is necessary to apply primer surfacer to the surface and polish the final repairing surface in order to solve such a disadvantageous phenomenon, consequently to increase the number of processes required.

(5) Area Repaired

Since this method requires many processes as noted above, the area, which is repaired by repeating the processes of applying various fillers and polishing the repairing surface, is resultantly increased. Thus, this method is disadvantageous in that the repaired area finally becomes remarkably larger than the initial area of the damaged portion to be repaired primarily.

Polishing Process

The polishing process for finishing the repairing surface principally requires a work of wet rubbing (manual polishing). This work which should be carried out by small amounts possesses the drawback of decreasing its efficiency. Besides, the wet rubbing work possibly brings about a blister (bulging) on the coating surface. Furthermore, the polishing process disadvantageously causes harm to an environment since it discharges a large volume of polluted water including the coating composition.

(7) Working Tool

Since this method requires a large number of processes, many kinds of tools such as a sanding machine and some sandpapers are used. As a result, this method entails problem such that the work becomes complicated, thus to increase production costs.

In Japanese Patent Publication No. SHO 56-23664 relating to an improvement in a filler process as noted above, there is disclosed a repairing and coating method for repairing a coating defect portion or the like of an automobile body by uniformly spraying a spray patty composed of unsaturated polyester resin and a curing agent onto the surface to be repaired, polishing the surface after dried, applying a topcoating composition onto the surface, and then drying the surface with the topcoating. The prior art invention provides a simplified filler process in which coating and polishing is easily carried out by the use of spray putty in place of the polyester putty, primer surfacer and lacquer patty, which should be processed repeatedly. However, the prior art invention proposes a mere improvement in the putty composition, and makes use of the conventional sanding and polishing processes. Thus, it could not sufficiently develop the efficiency of the work of performing the filler process, and therefore, has not been put into practice because the finished surface of the coating resultantly becomes rather rough.

2. Sheet Metal Process

In the sheet metal process, the damaged coating (old coating) is removed and the verge portion from which the old coating is removed is subjected to a feathering edge treatment. Recently, this work requires antithetical processes of scraping and smoothing the surface to be repaired by using two types of sanding machines such as a single-action sanding machine and a double sanding machine, which are provided with different sandpaper disks.

Thus, the conventional sheet metal processing work is composed of a plurality of processes, resulting in decreasing the working efficiency, regardless of the fact that the processes have the essentially common functions of sanding and polishing by use of the sanding machines and sandpaper disks.

OBJECT OF THE INVENTION

In the light of the foregoing circumstances, the present invention has an object to develop a method of working such as coating and polishing, patty compositions, and tools, and provide a method for forming undercoating in repair coating in order to simplify repairing processes, shorten working time, decrease costs of tools and materials for use therein, and form a finish surface of high quality.

Specifically, the present invention has another object to provide putty compositions capable of formation of a thick coating layer, which could not be achieved so far.

The present invention has further object to provide an undercoat forming method for preventing an area to be repaired from becoming larger than the initial area of the damaged portion to reduce an area finally repaired to a minimum.

SUMMARY OF THE INVENTION

To attain the objects described above, according to the present invention, there is provided a method for forming undercoating in repair coating on a damaged portion of a vehicle, comprising removing an old coating from the damaged portion, subjecting a verge portion of the damaged portion from which the old coating is removed to a feathering edge treatment, spraying putty composition composed of 100 parts by weight of main agent, which contains 25 to 40 percent by weight of unsaturated polyester resin and 23 to 13 percent by weight of reactive diluent so as to have a viscosity of 0.1 to 3.0 Pa.s, and 1 to 4 parts by weight of curing agent, to form a coating layer of about 1 mm at most, drying the putty sprayed, and dry-sanding the putty dried. This method is featured in that the processes of spraying the putty and dry-sanding the dried putty are performed respectively in only one operation.

That is, the putty consisting of the compositions noted above used in this invention has excellent spraying property, so that it can be sprayed thick and uniformly. Besides, the process of dry-sanding the dried putty enhances the efficiency of polishing. Consequently, the entire processes including the processes of spraying the putty and dry-sanding the dried putty, which are carried out in one operation, respectively, can be simplified and shortened in working time. Furthermore, the finally repaired area can be kept to a minimum in comparison with the initial area of the damaged portion.

The average grain size of the abrasive ground for use in the dry-sanding process is preferably 30 to 60 $\mu$m.

According to the method mentioned above, the putty can be polished efficiently, and the polished surface can be maintained flat.

Furthermore, in the dry-sanding process, a straight sanding machine provided with an abrasive base of polyester film can be used. The use of the polyester film enables the smoothness of the repaired surface to be improved.

Also, in the method of the invention, epoxy adhesives can be used as a fundamental adhesive agent, and urethane adhesives can be used as an upper coating adhesive.

The aforementioned method results in effects such that vibration easily propagates from the base of the abrasive ground to the abrasive grain, and abrasive chips are shaken off owing to the elasticity of upper coating adhesive.

Furthermore, the process of removing the old coating on the damaged portion and the process for subjecting the verge of the damaged portion from which the old coating is removed to the feathering edge treatment can be carried out by use of a double-action sanding machine. It is preferable to use the double-action sanding machine with the abrasive ground having the average grain diameter of 110 to 120 $\mu$m.

According to the method mentioned above, the process of removing the old coating and the feathering-edge process can be efficiently performed by use of one sanding machine. The smoothness of the ground and polished surface can be maintained.

Other objects and features of the present invention will be hereinafter explained in detail with reference to the accompanying drawings.

DESCRIPTION OF THE PREFERRED EMBODIMENTS

Figure 1:
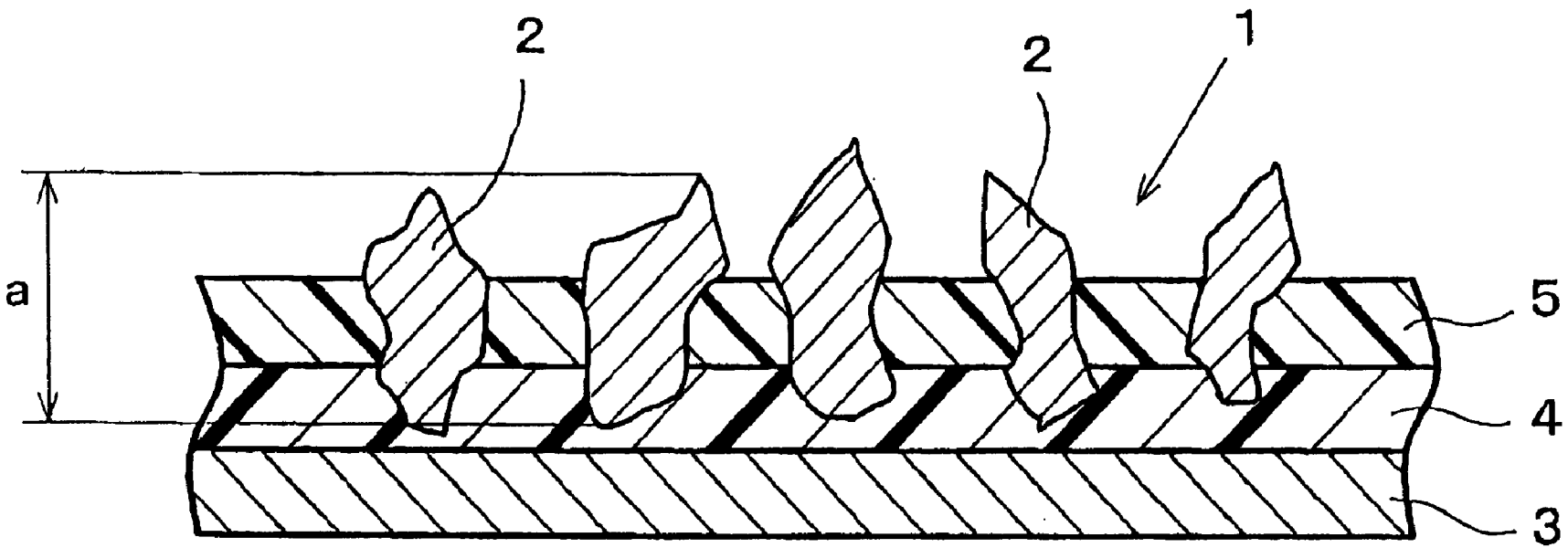
FIG. 1 is a typical diagram showing the section of an abrasive ground.
Figure 2:
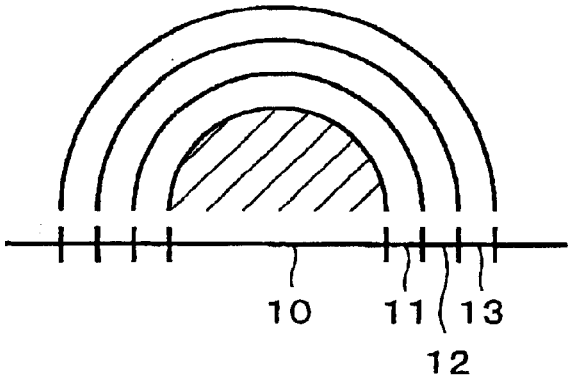
FIG. 2 is a typical diagram showing an area to be repaired by the method according to the present invention.

One embodiment of the present invention will be described hereinafter in detail.

In the undercoat forming method according to the invention, an old coating on a damaged portion of a vehicle is first removed, and the verge of the damaged portion from which the old coating is removed is subjected to feathering edge treatment, thereby to make the surface of the damaged portion smooth.

The two processes mentioned above can be effectively carried out by using one sanding machine. To put it concretely, a double-action sanding machine is suitably used. In general, the double-action sanding machine used therein is a sanding machine having a number of small rotating discs inside an large rotating disc, the small and large rotating discs being operated concurrently. Thus, since both the processes can be carried out by the aforesaid sanding machine, the efficiency of working can be improved.

It is preferable to use the abrasive ground for the aforesaid double-action sanding machine, which has grit size number #120 to #400. To be concrete, one or two sorts of abrasive ground may be desirably prepared in consideration of their aptitude with respect to the processes of removing the old coating, smoothing the verge of the damaged portion, scratch erasing (feathering) of the periphery of the damaged portion. It is more desirable to use the abrasive ground having grain size as uniform as possible so as to obtain a smooth polished surface without deep scratches. To be concrete, it is preferable to use the abrasive ground formed of the abrasive grain having the average grain size on the order of 110 to 120 $\mu$m. The abrasive grain having the aforesaid average grain size serves to reduce the grain size of the abrasive grain to a specific size. As a result, the difference between the maximum value and the minimum value of the grain size is decreased, thus to make the grain size uniform.

Next, the putty is applied to the damaged portion which is subjected to the aforesaid feathering edge treatment. The putty used therein is two-pack polymerizing type putty consisting of a main agent containing predetermined amounts of unsaturated polyester resin and reactive diluent so as to regulate its viscosity, and a curing agent. The two-pack polymerizing type putty gives rise to crosslinkage due to the main agent and curing agent to form polymer resin after dried. As a result, a high reliable resin layer which is far solid and tough in comparison with a solvent evaporation type putty can be advantageously produced. The application of the aforesaid putty is performed by a spray coating method. The spray coating method can dispense with a knifing work of the putty, which requires much skill, consequently to enhance the working efficiency.

If the unsaturated polyester resin is too small in quantity, a fault disadvantageously occurs in the coating layer with ease, consequently causing sinking of topcoating to produce a lusterless topcoating surface. Inversely, if the unsaturated polyester resin is too much, the viscosity thereof increases, thus to make the resin difficult to spray and coat uniformly. Accordingly, the amount of the unsaturated polyester resin is determined in accordance with these conditions. To be concrete, it is preferable to contain 25 to 40 percent by weight of unsaturated polyester resin in the main agent.

The reactive diluent has a function of decrease the viscosity of the main agent to render a good spraying property to the main agent, and is reacted and dried into the form of a coating layer. To be concrete, as the reactive diluent, styrene monomer is preferred. If the reactive diluent is too small in quantity, the viscosity thereof disadvantageously increases. Inversely, if reactive diluent is too much, a resultant coating layer becomes hard rapidly, consequently to be formed uneven. Accordingly, the amount of the reactive diluent is determined in accordance with these conditions. To be concrete, it is preferable to contain 23 to 13 percent by weight of unsaturated polyester resin in the main agent.

It is preferable to determine the viscosity of the main agent containing the aforementioned unsaturated polyester resin and reactive diluent in the range of 0.1 to 3.0 Pa.s. By determining the viscosity within the range, the balance of the spraying and drooling properties can be rationalized, so that the putty can be applied uniformly with high efficiency.

If the curing agent mentioned above is too small in quantity, the strength of the coating layer decreases disadvantageously, thus causing sinking of topcoating to produce a lusterless topcoating surface. Inversely, if the curing agent is too much, the resultant coating layer becomes hard rapidly, consequently to increase the strength thereof. As a result, the coating layer is hard to sand. Accordingly, it is preferable to contain 1 to 4 parts by weight of curing agent relative to 100 parts by weight of the main agent.

Next, the putty sprayed is dried. The drying temperature and time are appropriately determined in consideration of the compositions of the putty and thickness of the coating layer. In general, it is preferable to dry the putty at 70? or above for 20 to 30 minutes. Also, it is preferable to dry the putty by stably heating the entire area thereof uniformly at a constant temperature.

The aforementioned dry sanding process is suitably carried out by use of a straight sanding machine. The straight sanding machine used therein is a sander having a reciprocating pad. It is desirable to use the straight sanding machine having the pad made small and operated with a short stroke so as to pertain to processing of the damaged portion having a complicated configuration.

Furthermore, it is most preferable to use an abrasive ground attached to the straight sanding machine, which has grit size number #120 to #400. If the grit size of the abrasive ground is too small, the coating layer loses its smoothness. Inversely, if it is too large, the efficiency of processing is disadvantageously lowered. Also, if the abrasive grain 2 in the abrasive ground 1 has large dispersion in grain size a as shown in FIG. 1, deep scratches may possibly be produced in a part of the ground surface. To avoid this problem, the grain size a of the abrasive grain should be made as even as possible, so as to obtain an extremely smooth ground surface. To be concrete, it is desirable to use the abrasive ground having the average grain size a of 30 to 60 $\mu$m. The abrasive ground having the average grain size within the specified values results in reduction of the maximum value of the average grain size a to a specific value or less. As a result, the difference between the maximum value and the minimum value can be diminished, thus to make the abrasive grains 2 uniform. Incidentally, the wet sanding has not only a cushioning function of water, but also a function of cleaning abrasive chips (purgation), so that sandpaper scratches as touched upon above are relatively difficult to occur. On the contrary, since the dry sanding is free from water, it may possibly bring about the aforementioned problems. Therefore, the determination of the average grain size is of importance from the point of view of preventing the problems.

It is desirable that a base 3 of the abrasive ground 1 illustrated in FIG. 1 is made of a polyester film. The polyester film is stouter and harder to deform than paper which has been used as a base of the conventional abrasive ground. Thus, the use of the polyester film as the base of the abrasive ground enables the smoothness of the resultantly ground surface to be improved.

As a fundamental adhesive agent 4 illustrated in FIG. 1, an epoxy adhesive agent may be suitably used. Owing to the epoxy adhesive agent essentially having a strong adhesive power, the abrasive grain 2 is prevented from falling off, consequently to prolong the life time of the abrasive ground and improve the working efficiency.

As an upper coating adhesive agent 5 illustrated in FIG. 1, a high-elastic adhesive agent such as urethane adhesive may be suitably used. Owing to the upper coating adhesive agent having high elasticity, swing amplitude of the tip end of the abrasive grain is increased, resulting in shaking off abrasive chips, which are apt to enter into grooves. Consequently, plugging and entwining of the abrasive chips can be prevented thoroughly.

On the upper coating adhesive agent 5, there may be further formed metallic soap, which is fused with frictional heat generated in sanding, so that the aforementioned abrasive chips coated with the upper coating adhesive agent can easily come off. Thus, plugging and entwining of the abrasive chips can be prevented more completely in cooperation with the function of shaking off the abrasive chips as noted above.

The dry sanding process involves slight scattering of particle dust. To prevent the particle dust from scattering, it is desirable to provide the sanding machine or hand file with a hose to be attached to a dust collecting bag or dust collector (cleaner).

Figure 3:
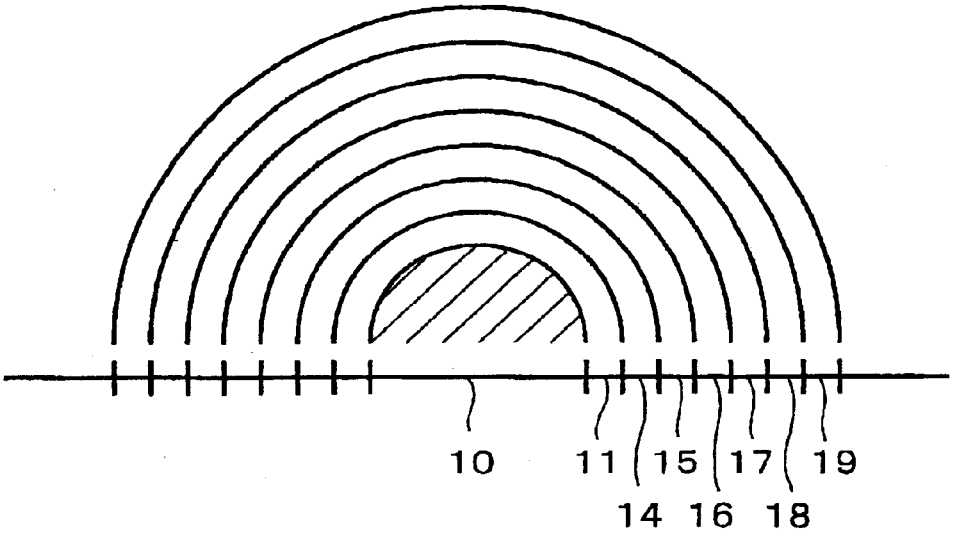
FIG. 3 is a typical diagram showing an area repaired by a conventional method.

As described above, according to the undercoat forming method according to the present invention, the processes of coating and sanding the putty are respectively performed in one operation, so that the area finally repaired, which becomes generally larger than the initial area of the damaged portion, can be reduced to a minimum. That is, the final area after repaired is generally increased by 2 to 3 cm in one operation of coating and sanding the putty. However, as shown in FIG. 3, the conventional repairing method in which the damaged portion 10 is repaired by performing the feathering process 11 on the outside of the damaged portion, polyester putty applying process 14, polyester putty polishing process 15, primer surfacer applying process 16, primer surfacer polishing process 17, lacquer patty applying process 18, and lacquer patty polishing process 19 in order resultantly brings about expansion of the repaired area by 14 to 21 cm in total in one operation. In this regard, resultant expansion of the repaired area resulting from repairing according to the undercoat forming method of the present invention, in which the damaged portion is repaired by performing the feathering process 11 on the outside of the damaged portion, putty applying process 12, and putty polishing process 13 in order, can be reduced to mere one-fourth or less of the repaired area resulting from the conventional method.

Incidentally, when the depth of the damaged portion of a vehicle body exceeds the limit of the coating thickness (about 1 mm) of the aforesaid putty, the so-called sheet-metal putty or middle putty, which excels in impasto property may be suitable applied in advance. In this case, if decision as to whether or not the aforesaid depth of the damaged portion exceeds the limit of the coating thickness of the putty is inaccurate, short padding of the coating after polished occurs, consequently involving additional application of filler. Thus, accurate decision is of basic importance for avoiding inefficient coating.

Next, a concrete embodiment will be described in more detail to clarify the characteristic of the present invention, but should not be understood as being limited thereto.

The descriptive embodiment according to the present invention is related to a repair coating on an automobile and discussed herein on working time in comparison with the conventional method. The method of the present invention and the conventional method are put into practice in the following manners.

Method of the Present Invention

1. Removing of the old coating on the damaged portion, smoothing of verge of the damaged portion, and rubbing-out of the surrounding scratches (feathering) were effected by use of a double-action sanding machine. Sandpapers used in these processes have grit size number #120 and the average grain size of 115 $\mu$m for smoothing of verge of the damaged portion, and grit size number #400 and the average grain size of 30 $\mu$m for rubbing-out of the surrounding scratches.

2. Onto the damaged portion subjected to the feathering edge treatment, there was sprayed the putty composed of 100 parts by weight of main agent containing 33 percent by weight of unsaturated polyester resin and 23 percent by weight of styrene monomer serving as the reactive diluent, and 1.6 parts by weight of curing agent.

3. After drying the putty sprayed on the damaged portion, the putty was subjected to dry sanding by use of a straight sanding machine. There were used sandpapers having grit size numbers #120 and #400 and the average grain size of 30 to 60 $\mu$m. The sandpapers each comprising an abrasive base of polyester film, a fundamental adhesive agent of epoxy, and an upper coating adhesive agent of urethane were used.

Conventional Method

1. Removing of the old coating on the damaged portion was effected by using a single-action sanding machine. Sandpapers having grit size numbers #30 to #60 were used therein. Subsequently, smoothing of the verge of the damaged portion was effected by using a double-action sanding machine with sandpapers having grit size numbers #60 to #120. Further, rubbing-out of the surrounding scratches was effected by using the double-action sanding machine with sandpapers having grit size numbers #120 to #240.

2. To the damaged portion subjected to the feathering edge treatment, two-pack polymerizing type polyester putty was applied by knifing and then dried. Subsequently, the dried polyester putty was polished by wet sanding with sandpapers having grit size numbers #180 to #240.

3. Onto the polyester putty, solvent evaporation type primer surfacer was sprayed and then dried. Subsequently, the dried polyester putty is polished by wet sanding with sandpapers having grit side numbers #400 and #600.

4. Onto the polyester putty, solvent evaporation type lacquer patty was sprayed and then dried. Subsequently, the dried polyester putty is polished by wet sanding with sandpapers having grit side numbers #240 and #320.

The subjects of repairing were the following ten parts:

Subject 1: U13 Rear quarter panel

Subject 2: U13 Door frame

Subject 3: U13 Trunk lid

Subject 4: U13 Rear quarter panel

Subject 5: U13 Front door

Subject 6: U13 Front door

Subject 7: B13 Rear quarter panel

Subject 8: B13 Rear quarter panel

Subject 9: B13 Fender

Subject 10: B13 Door upper portion

Figure 4:
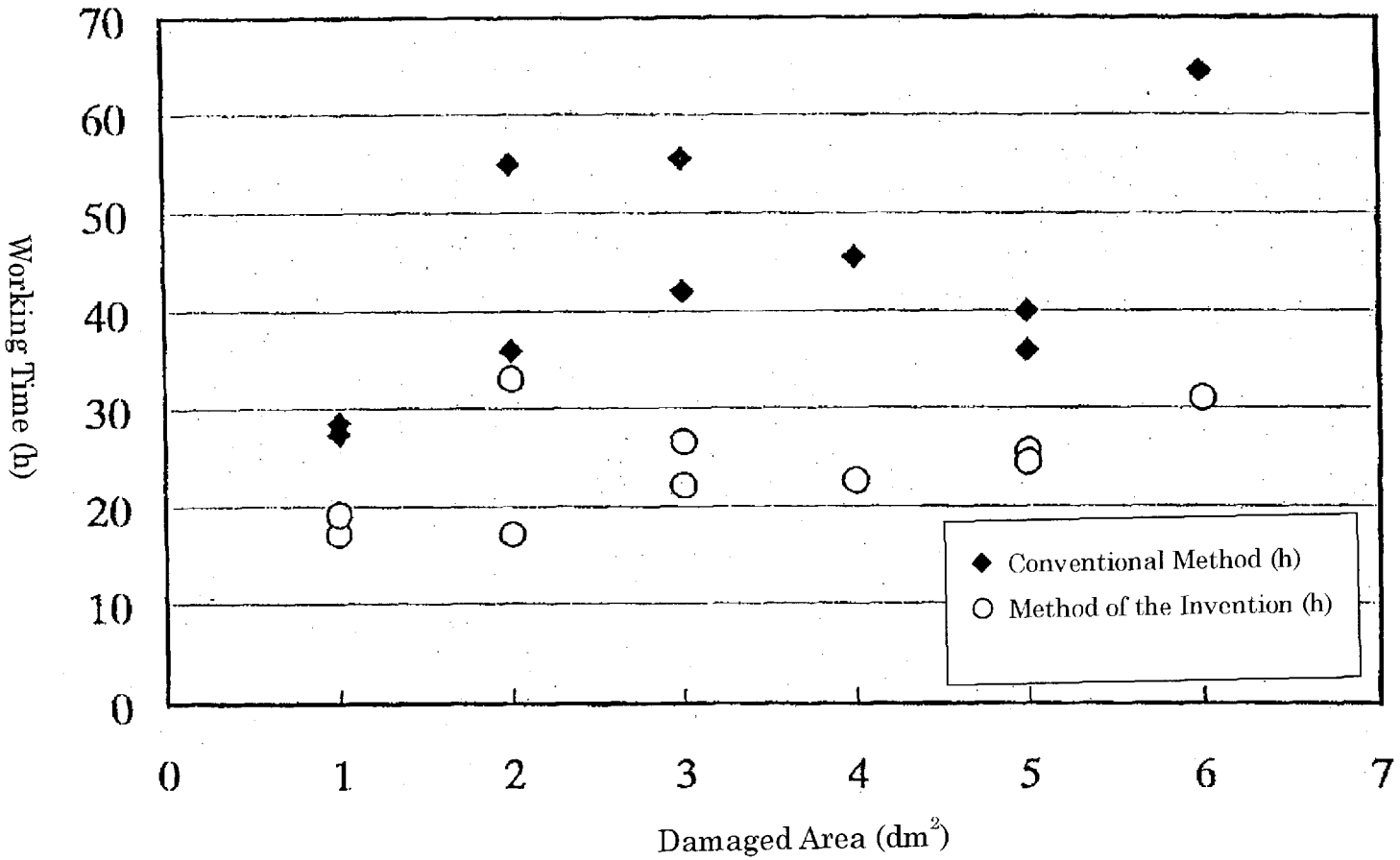
FIG. 4 is a graph showing the comparison in working time between the conventional method and the method of the present invention.

Measurement results of the working times are shown in Table 1. A graph in which the working times per damaged area to be repaired are plotted is shown in FIG. 4.

It is evident from the measurement results that the working efficiency according to the undercoat forming method of the present invention increases 43% on average over the conventional method. The ratio of the undercoating process to the entire repair coating processes (inclusive of the finish coating process) is 50% of those of the conventional method. Thus, the efficiency rate on the entire repair coating processes according to the present invention was 0.5×0.43=0.215.

TABLE 1

Comparison of working time for undercoating between the method of the Invention and the conventional method

| | $dm^2$ | Degree of Difficulty | Line | Inverse Radius | Remarks | Conventional Method (h) | Present Invention (h) | Efficiency Rate |
|---|---|---|---|---|---|---|---|---|
| Subject 1 | 1 | 1 | | | | 27.5 | 17 | 38% |
| Subject 2 | 2 | 4 | Yes | Yes | complex | 55 | 33 | 40% |
| Subject 3 | 1 | 2 | | | Horizontal | 28.5 | 19 | 33% |
| Subject 4 | 2 | 3 | Yes | Yes | | 36 | 17 | 53% |
| Subject 5 | 6 | 4 | Yes | Yes | complex | 64.5 | 31 | 52% |
| Subject 6 | 5 | 1 | | | | 36 | 25.5 | 29% |
| Subject 7 | 5 | 1 | | | | 40 | 24.5 | 39% |
| Subject 8 | 3 | 3 | Yes | Yes | | 42 | 22 | 48% |
| Subject 9 | 3 | 3 | Yes | Yes | | 55.5 | 26.5 | 52% |
| Subject 10 | 4 | 1 | | | | 45.5 | 22.5 | 51% |
| Average | | | | | | 43.1 | 23.8 | 43% |

As is apparent from the foregoing description, the undercoat forming method according to the present invention makes it possible to obtain a good finishing condition, form a desired thick coating layer, simplify the repairing processes, shorten the working time and reduce costs of tools and materials, as the result of which consumers can enjoy a low repairing cost and reliable service of repairing. Furthermore, the finally repaired area can be kept to a minimum in comparison with the initial area of the damaged portion.

What is claimed is:

1. A method for forming undercoating in repair coating on a damaged portion of a vehicle, comprising removing an old coating from said damaged portion, subjecting a verge portion of said damaged portion from which said old coating is removed to a feathering edge treatment, spraying a putty composition composed of (1) 100 parts by weight of main agent containing 25 to 40 percent by weight of unsaturated polyester resin and 23 to 13 percent by weight of reactive diluent so as to have a viscosity of 0.1 to 3.0 Pa.s, and (2) 1 to 4 parts by weight of curing agent, to form a coating layer of about 1 mm at most, drying said sprayed putty, and dry-sanding said dried putty, wherein said spraying, drying and dry-sanding are performed respectively in one operation.

2. The method for forming undercoating according to claim 1, wherein said dry-sanding is performed by using abrasive ground with abrasive grain of 30 to 60 $\mu$m in average grain size.

3. The method for forming undercoating according to claim 1, wherein said dry-sanding is performed by using a straight sanding machine with abrasive ground having an abrasive base of polyester film.

4. The method for forming undercoating according to claim 3, wherein said abrasive ground includes a fundamental adhesive agent of epoxy and an upper coating adhesive of urethane.

5. The method for forming undercoating according to claim 1, wherein said removing of said old coating on said damaged portion, and said feathering of verge of said damaged portion are effected by use of a double-action sanding machine with abrasive grain of 110 to 120 $\mu$m in average grain size.

6. The method for forming undercoating according to claim 2, wherein said removing of said old coating on said damaged portion, and said feathering of verge of said damaged portion are effected by use of a double-action sanding machine with abrasive grain of 110 to 120 $\mu$m in average grain size.

7. The method for forming undercoating according to claim 3, wherein said removing of said old coating on said damaged portion, and said feathering of verge of said damaged portion are effected by use of a double-action sanding machine with abrasive grain of 110 to 120 $\mu$m in average grain size.

8. The method for forming undercoating according to claim 4, wherein said removing of said old coating on said damaged portion, and said feathering of verge of said damaged portion are effected by use of a double-action sanding machine with abrasive grain of 110 to 120 $\mu$m in average grain size.

* * * * *